US006805482B2

(12) United States Patent
Bérard

(10) Patent No.: US 6,805,482 B2
(45) Date of Patent: Oct. 19, 2004

(54) OPERATION LEVEL INDICATOR DEVICE

(75) Inventor: Vincent Bérard, La Chaux-de-Fonds (CH)

(73) Assignee: Vaucher Manufacture Fleurier SA, Fleurier (CH)

( * ) Notice: Subject to any disclaimer, the term of this patent is extended or adjusted under 35 U.S.C. 154(b) by 0 days.

(21) Appl. No.: 10/476,680

(22) PCT Filed: Feb. 28, 2002

(86) PCT No.: PCT/IB02/00600

§ 371 (c)(1),
(2), (4) Date: Nov. 4, 2003

(87) PCT Pub. No.: WO02/095504

PCT Pub. Date: Nov. 28, 2002

(65) Prior Publication Data

US 2004/0145974 A1 Jul. 29, 2004

(30) Foreign Application Priority Data

May 22, 2001 (EP) ..... 01810508

(51) Int. Cl.[7] ..... G04B 25/00; G04B 9/00
(52) U.S. Cl. ..... 368/151; 368/210; 368/212
(58) Field of Search ..... 368/147–152, 368/206–212

(56) References Cited

U.S. PATENT DOCUMENTS 744,456 A * 11/1903 Aumen ..... 368/210
941,143 A * 11/1909 Hawkins ..... 368/212
1,623,907 A * 4/1927 Burke ..... 368/88
2,761,274 A * 9/1956 Aurele ..... 368/212
3,878,673 A * 4/1975 Meitinger ..... 368/209
6,340,241 B2 * 1/2002 Jeanneret ..... 368/210
6,685,352 B1 * 2/2004 Capt et al. ..... 368/206

FOREIGN PATENT DOCUMENTS

DE 233062 C * 3/1911
DE 319748 C * 3/1919

* cited by examiner

*Primary Examiner*—Vit W. Miska
(74) *Attorney, Agent, or Firm*—Kirkpatrick & Lockhart LLP; Anthony H. Handal

(57) ABSTRACT

This invention has for object to propose an operation level indicator device for watches with double spring barrels, both those with manual winding and those with automatic winding.

This scope is reached by an operation level device, having two spring barrels 1, 2, one for winding 1 and the other for unwinding 2, a star wheel 3 integral with a display means 17. According to the invention, the winding spring barrel includes a winding pin 9 actuating a winding lever 4 dragging the star wheel 3 into positive rotation, the unwinding spring barrel 2 includes an unwinding pin 10 actuating an unwinding lever 5 that drags the star wheel 3 into negative rotation, the latter being maintained in its position by a catch 8.

8 Claims, 5 Drawing Sheets

OPERATION LEVEL INDICATOR DEVICE

This invention is related to a clockwork element, more particularly to the mechanism allowing to measure and to display the working energy stored in a watch.

The mechanical watches with manual winding comprise compulsorily of a winding system, called winder. This device manually transmits the energy to the drum turret, the energy accumulator of the watch. The winder is also used for other functions, such as setting or change of dates.

By turning the crown, the flowing pinion being engaged in the winder pinion, the crown wheel is made to rotate. The latter puts the ratchet wheel into rotation, which is fixed on the shaft of the drum turret, This is how the drum turret is charged in a traditional watch. The calculation of the number of winding/unwinding rotations is perfectly mastered.

In order to increase the autonomy of a watch, it is known to use motions with double drum turrets, as disclosed in the patent CH 610465, in particular FIG. 2. The principle of the aforementioned winding is applicable to watches of this type.

It has proved useful to indicate the autonomy of such watches, be it for simple watches or with double drum turrets. This indication is called "operation level". Such a device is described in the document EP 0 568 499. This device is complicated and needs many components and applies only to a watch with a simple drum turret.

The scope of this invention is to propose an operation level indicator device for watches with double drum turrets, both those with manual winding and those with automatic winding.

This scope is reached by an operation level device having two spring barrels, one for winding and the other for unwinding, a star wheel integral with a displaying means, characterized in that the winding spring barrel includes a winding pin actuating a winding lever that puts the star wheel in positive rotation, while the spring barrel for unwinding includes an unwinding pin actuating an unwinding lever that puts the star wheel in negative rotation, the latter being maintained in its position by a catch.

This invention applies first of all, to watches with two spring barrels. The particularity of the mechanism with double spring barrels is due to the fact that at the moment of winding, only one spring barrel is in rotation, the second remaining immobile. Inversely, during unwinding, the second spring barrel is in rotation while the first remains immobile.

The great autonomy of the system with double spring barrels makes it useful to have an operation level display available. For this purpose, the existing mechanism of the double spring barrels is used adding two levers. The adding of the operation level indicator device will affect the spring barrels as well as the display.

The winding is carried out by turning the winder crown, the flowing pinion meshing with the winder pinion. The latter meshes with the crown wheel that drives the ratchet wheel (fixed on the shaft of the unwinding spring barrel). In this way, the spring barrels are wound up and carry out their first function, namely: to store the necessary energy for the working of the watch. A winding pin has been fixed on the winding spring barrel. According to the rotation, motion of this spring barrel, said pin comes into contact with a lever whose tilting to its opposed end will actuate the star wheel on which the display is placed.

The winding is carried out by means of an oscillating mass, whose rotation is assured by motions of the arm and across a combination of ratchets and of wheels, and arms the spring. The spring barrel is so wound up and carries out its first function, namely: to store the necessary energy at the working of the watch. A winding pin has been fixed on the winding spring barrel. According to the rotation motion of this spring barrel, said pin comes into contact with a lever whose tilting, to its end opposed, actuates the star wheel on which the display is situated.

The two levers, the winding lever and the unwinding lever, are disengaged from the star wheel by pull-back springs. This allows to free the star wheel for the action of the lever which is in tilting.

A catch resting on the star wheel warrants to the latter its maintenance in position defined by the action of the levers.

Each of the levers is mounted on a rotation axis, one of the sides being positioned in face of the toothing of the star wheel, the other side being placed referring to the pin of the spring barrel.

The invention will be better understood thanks to the following detailed description referring to the drawings annexed in which.

Figure 1:
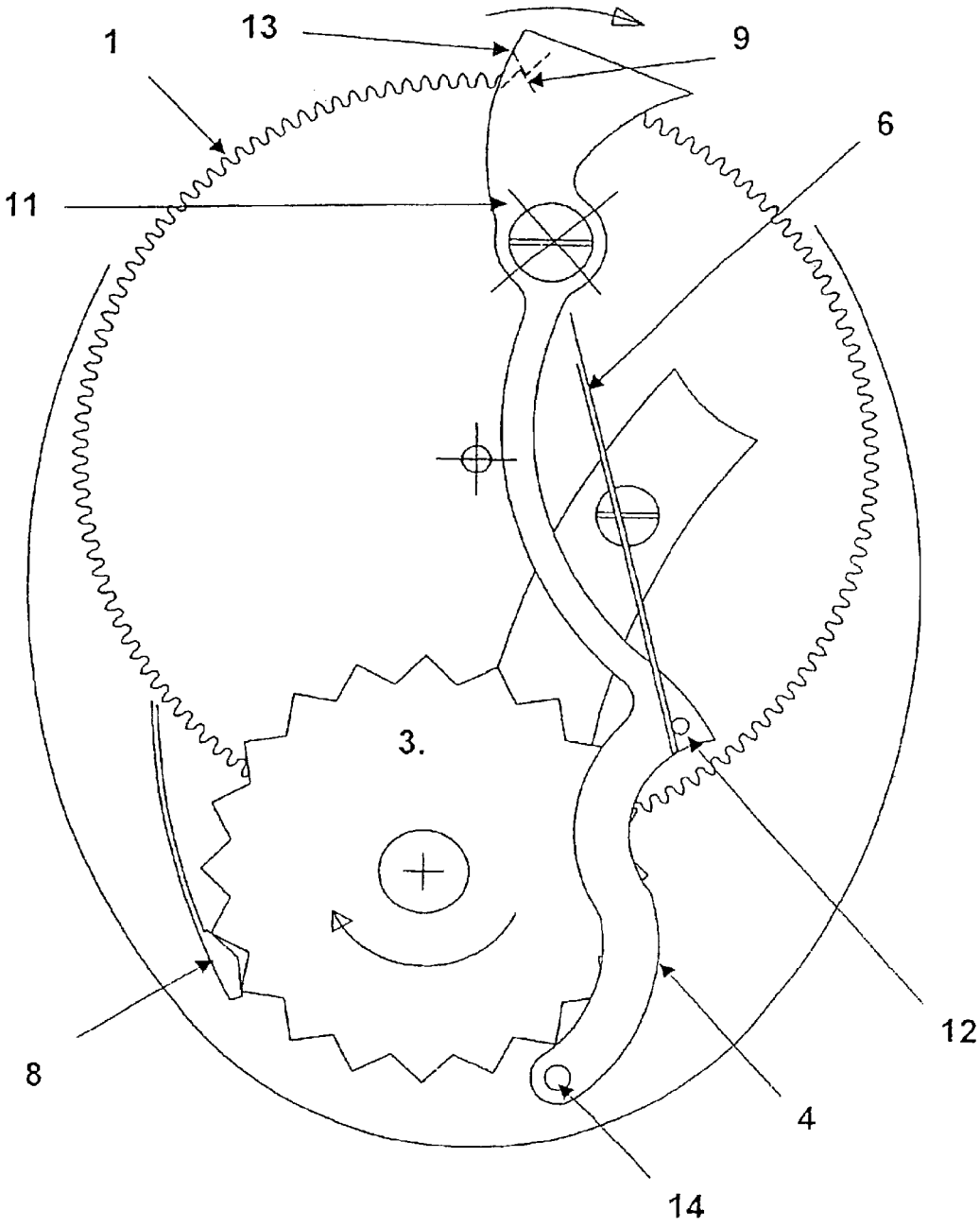
FIG. 1 represents a charge level indicator with its winding mechanism.

FIG. 1 describes the winding part of the spring barrels with its driving mechanism for an indication wheel (star wheel) 3 by a winding lever 4.

A first lever called winding lever 4 is mounted on a rotation axis 11 integral with a bridge that is not represented. One of the ends of this lever 4 comprises a pin 14, the other end being terminated by a spigot 13 with driving function. This winding lever 4 is maintained in its resting position by a pull-back spring 6 resting on the pin 12, said spring having the function to lead back the winding lever 4 to its rest position, that is to say out of the circumference of the star wheel 3. The impulse given by the pin 14 allows the rotation of the star wheel of one tooth in the positive direction (sense of winding).

The winding spring barrel 1 includes a winding pin 9 placed on the periphery of the spring barrel 1. At each rotation of this spring barrel, the winding pin 9 drags the spigot 13 of the winding lever. 4, said lever meshing by rotation into the toothing of the star wheel 3 thanks to the driving pin 14.

Figure 2:
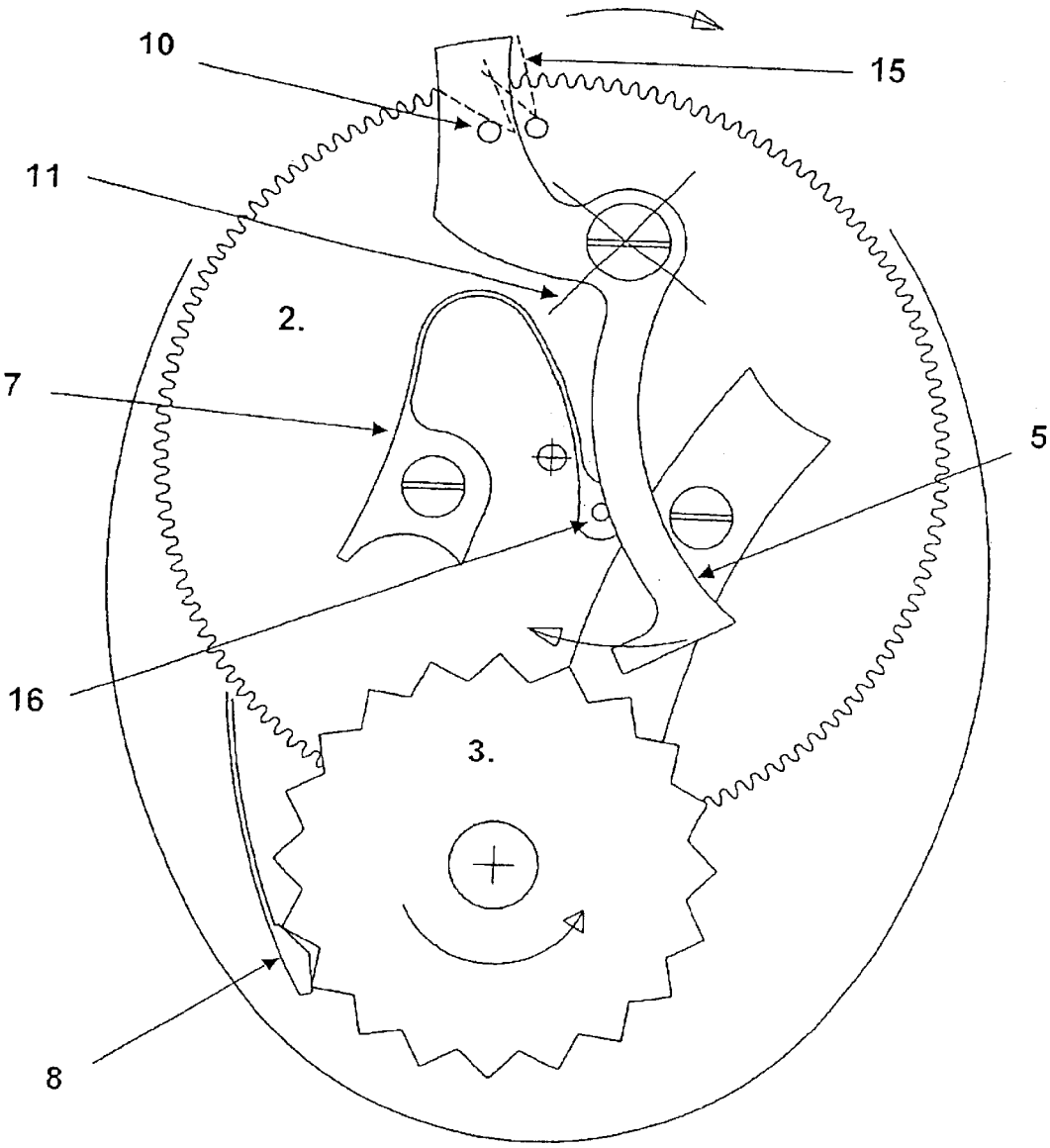
FIG. 2 represents a charge level indicator with its unwinding mechanism.

In FIG. 2, the part responsible for the winding has been voluntarily taken away. The unwinding lever 5 at one of its ends includes a spigot 15 represented in dotted lines in the figure, driven by an unwinding pin 10 integral with the unwinding spring barrel 2. At each rotation of this spring barrel 2, the unwinding lever 5 tilts around its rotation axis 11 and drags the star wheel 3 of a tooth in said negative direction (sense of unwinding).

This unwinding lever 5 is maintained in its resting position by a pull-back spring 7 resting by means of a pin 16, said spring having the function to lead back the unwinding lever 5 to its rest position, that is to say out of the circumference of the star wheel 3.

The function of the catch 8 is on the one hand to warrant the maintenance of the star wheel 3 in its indication position and on the other hand to participate in the tilting.

In fact, at each impulse either of the winding pin 14, or the end of the unwinding lever 5, the catch 8 allows to end the travel of a tooth.

Figure 3:
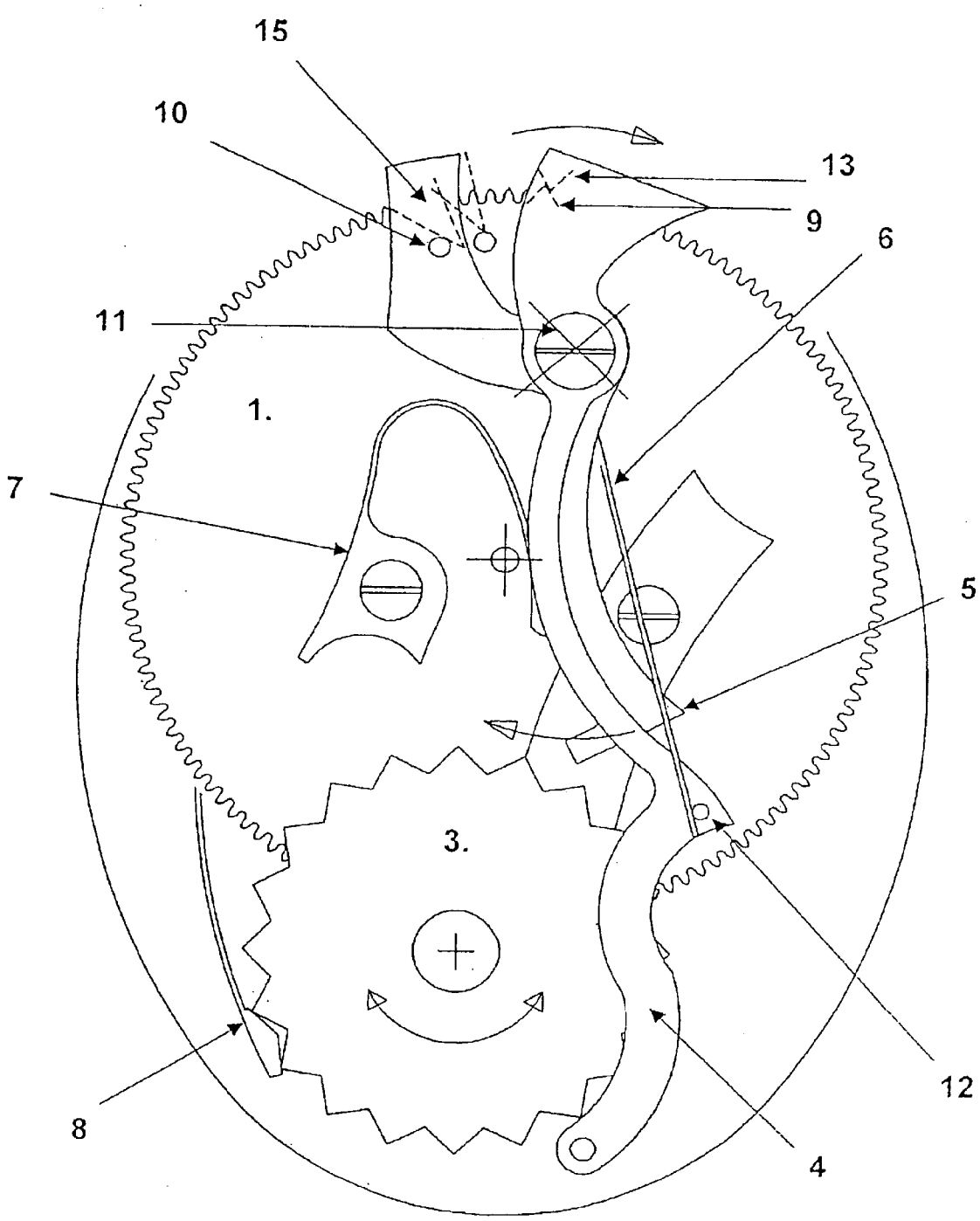
FIG. 3 represents a top view illustrating the two mechanisms, winding and unwinding.

FIG. 3 represents a top view of the complete mechanism with its two levers. The latter are mounted on a same axis 11 and one can observe the double function of winding and of unwinding.

Figure 4:
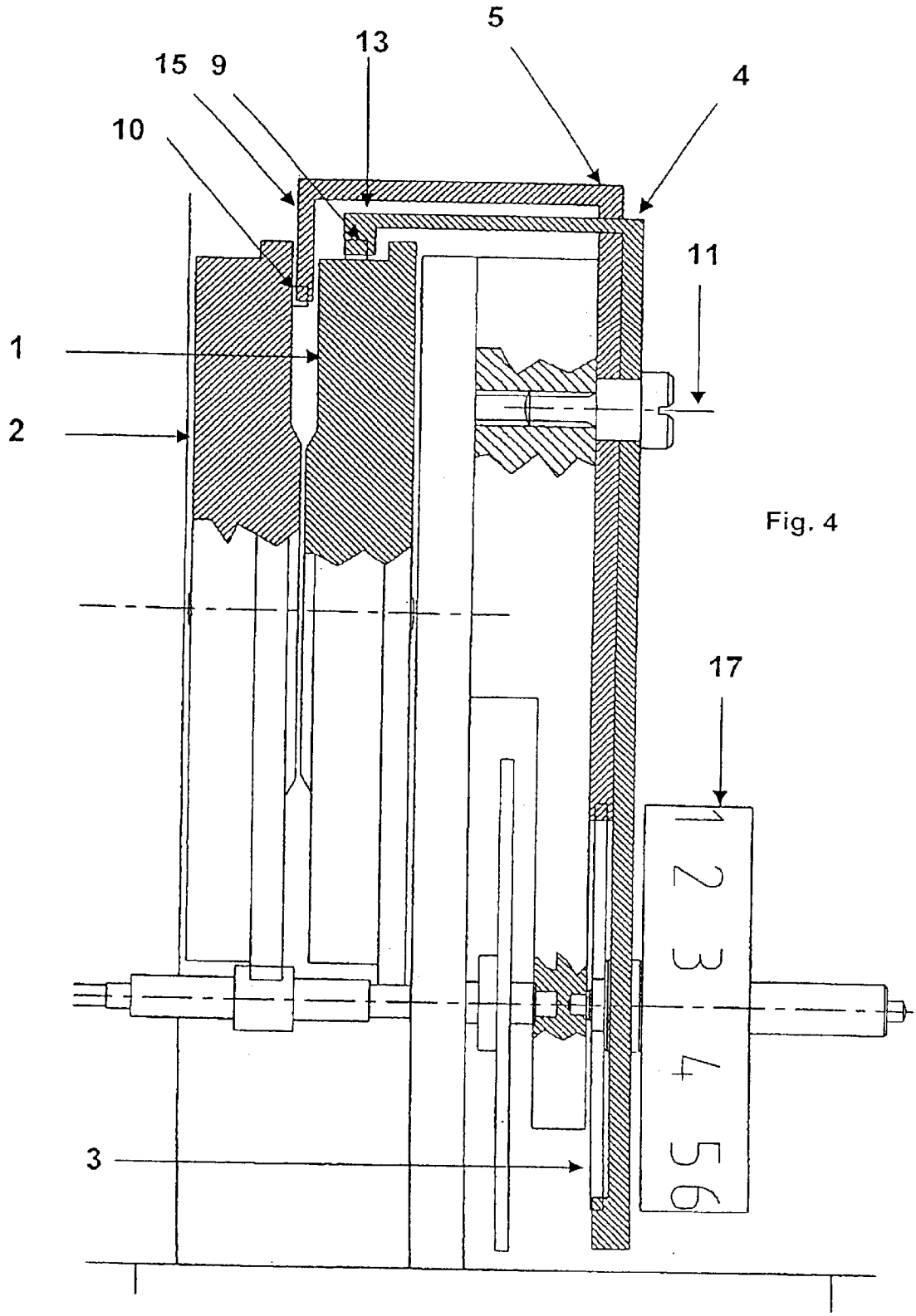
FIG. 4 represents, in section, the charge level indicator with its negative/positive rotation mechanism and two superposed spring barrels.

The FIG. 4 is a section of the assembly according to a plane determined by the axes of the spring barrels and of the star wheel. The axis of the star wheel 3 is integral with the display means for the operation level, in our case a graduated drum 17. The latter, by means of a counter serving as a fixed mark, will indicate the operation level of the watch.

One can observe the two spring barrels coaxially mounted and on each of them a driving pin is placed. The winding lever 4 takes its motion on the pin 9 integral with the upper spring barrel 1. On the other hand, the unwinding lever 5 takes its motion on the pin 10 integral with the lower spring barrel 2.

The location of the pins on the spring barrels is not important in itself, be it on the board of the spring barrel as disclosed on the unwinding spring barrel 2, or on the drum as disclosed on the winding spring barrel 1.

Figure 5:
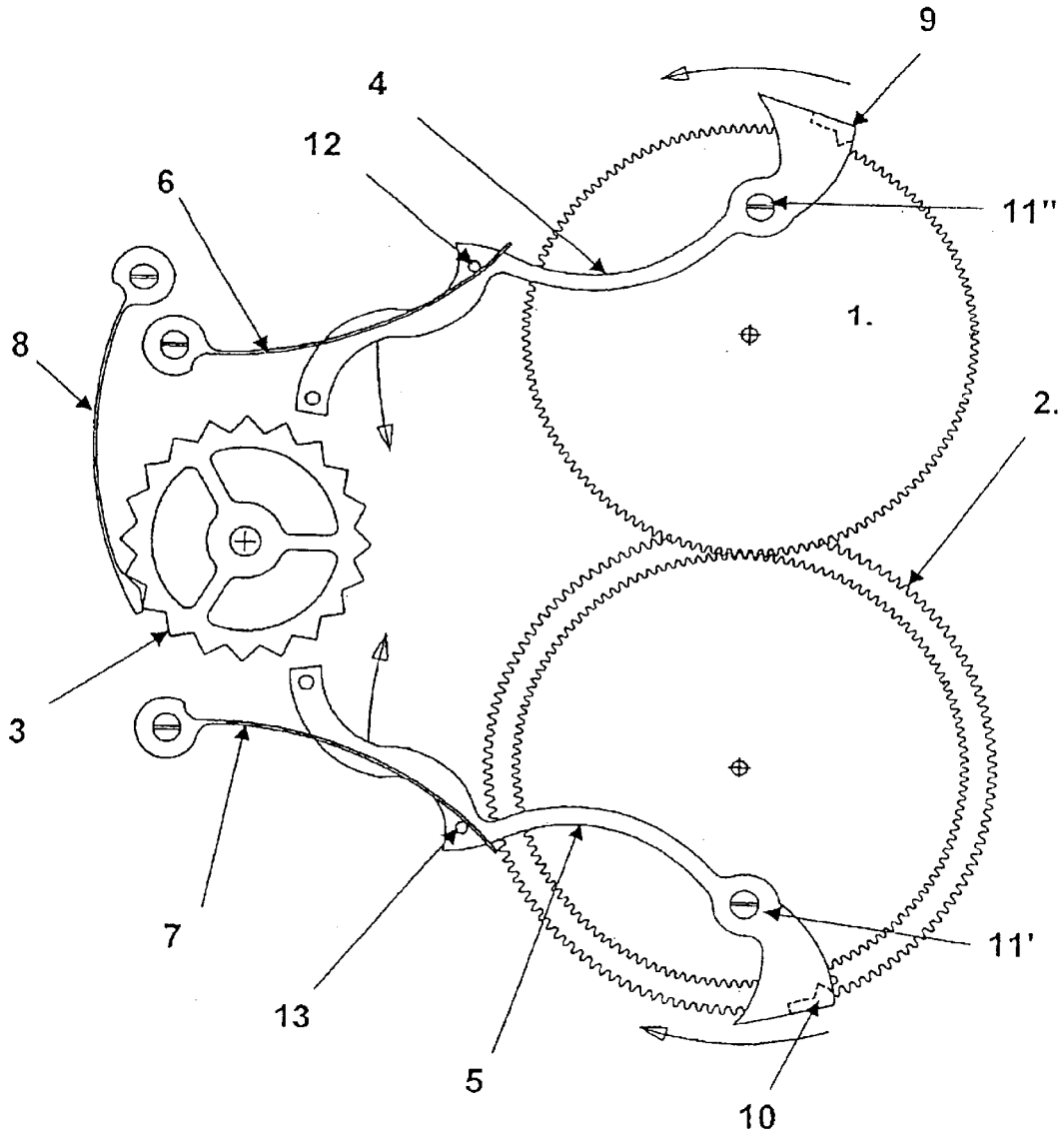
FIG. 5 represents the charge level indicator with its negative/positive rotation mechanism and two spring barrels side by side.

FIG. 5 represents a variant of the invention with the two spring barrels mounted on a same plane. The system of the invention applies also in this case, the main difference being the fact that each lever has its own axis, 11' and 11".

The same elements, namely the pins, are found on the spring barrels 1 and 2, which provoke the tilting of each respective lever.

It should be noted that other display forms can be used within the limits of this invention; for example by means of a simple needle situated on the star wheel, the charge level indication marks being in this case fixed on a face.

Furthermore, the number of pins for each spring barrel can be higher than one, according to the chosen type of display. In fact, if the teeth number of the star wheel is big, it can be desirable to cause the driving of two teeth for each rotation of spring barrel.

What is claimed is:

1. Operation level device, having two spring barrels (1, 2), one for winding (1) and the other for unwinding (2), a star wheel (3) integral with a display means (17), characterized in that the winding spring barrel (1) includes at least one winding pin (9) actuating a winding lever (4) dragging the star wheel (3) into positive rotation, the unwinding spring barrel (2) includes at least one unwinding pin (10) actuating an unwinding lever (5) that drags the star wheel (3) into negative rotation, the latter being maintained in its position by a catch (8).

2. Device according to claim 1, characterized in that the winding lever (4) is pulled back into its rest position by a pull-back spring (6) allowing the winding lever (4) to disengage from the star wheel (3).

3. Device according to claim 1, characterized in that the unwinding lever (5) is pulled back into its rest position by a pull-back spring (7) allowing the unwinding lever (5) to disengage from the star wheel (3).

4. Device according to claims 1 to 3, characterized in that the star wheel (3) is maintained in its position by a catch (8).

5. Device according to claim 4, characterized in that the two spring barrels are mounted on a same axis and that the winding (4) and unwinding (5) levers are mounted on a common axis.

6. Device according to claim 4, characterized in that the spring barrels are mounted on a same plane, each lever having its rotation axis.

7. A watch having the device according to claim 5.

8. A watch having the device according to claim 6.

* * * * *